United States Patent [19]
Dyer
[11] 4,402,495
[45] Sep. 6, 1983

[54] DRILL STRING SHOCK ABSORBER WITH PRESSURIZED LUBRICANT SYSTEM

[75] Inventor: Billy F. Dyer, Houston, Tex.

[73] Assignee: Hughes Tool Company, Houston, Tex.

[21] Appl. No.: 311,500

[22] Filed: Oct. 15, 1981

Related U.S. Application Data

[63] Continuation of Ser. No. 101,616, Dec. 10, 1979, abandoned.

[51] Int. Cl.[3] ..... F21B 17/02; F16F 9/18
[52] U.S. Cl. ..... 267/125; 464/18
[58] Field of Search ..... 267/125, 65 R, 124, 267/137; 175/227, 228, 229, 320, 321, 322; 464/18, 21

[56] References Cited

U.S. PATENT DOCUMENTS 3,746,329 7/1973 Galle ..... 267/125
4,055,338 10/1977 Dyer ..... 64/23
4,106,779 8/1978 Zabcik ..... 64/23

*Primary Examiner*—James B. Marbert
*Attorney, Agent, or Firm*—Robert A. Felsman; James E. Bradley

[57] ABSTRACT

A shock absorbing apparatus for use in a drill string for earth boring operations has a pressurized lubrication system. The shock absorber has a tubular body and a mandrel reciprocally mounted in the body for rotation with it. The mandrel and body telescope with respect to each other, with an annular pressurized chamber being located between them for absorbing load and shock. Lubricant cavities contain lubricant for lubricating the seals of the pressurized chamber. The lubricant in the lubricant cavities is maintained at a pressure greater than ambient but less than that in the pressurized chamber. This is accomplished by utilizing a differential piston that operates in response to the pressure differential between the chamber and the lubricant in the lubricant cavity.

3 Claims, 2 Drawing Figures

DRILL STRING SHOCK ABSORBER WITH PRESSURIZED LUBRICANT SYSTEM

This is a continuation of application Ser. No. 101,616, filed Dec. 10, 1979, now abandoned.

BACKGROUND OF THE INVENTION

I. Field of the Invention

This invention relates in general to rotary well drilling, particularly to shock absorbing apparatus used in the drill string to minimize vibrations transmitted from a drill bit, through the drill string and to the equipment at the surface of the earth.

II. Description of the Prior Art

Shock absorbing apparatus used in the drill string of a rotary well drilling apparatus may be classified into two types: (1) Shock absorbers for oil well drilling and (2) shock absorbers for hole drilling for other industrial purposes such as blast hole drilling.

Representive of shock absorbers used in drilling oil and gas wells may be seen in U.S. Pat. Nos. 3,382,936 and 3,746,329. In these shock absorbers a gas cavity is formed between a mandrel and a tubular body for supporting the load imposed upon the drill bit and for absorbing any shock loading or vibrations that would otherwise be transmitted between the drill bit and the equipment at the surface of the earth. Due to the large hydrostatic pressure of the liquid drilling fluids used to drill deep oil and gas wells, it would be difficult to seal between this large hydrostatic pressure and the much lesser pressure of the gas inside the apparatus. To solve this problem there is disclosed in U.S. Pat. No. 3,382,936 a pressure transmitting liquid chamber which communicates with the gas cavity inside the apparatus and the ambient drilling fluid. As a consequence, the liquid in the intermediate liquid chamber may be sealed much easier than the gas due to the relatively high viscosity of liquid when contrasted with gas. The liquid and gas inside the apparatus is prevented from intermingling by use of a movable and fluid responsive separation element, which in U.S. Pat. No. 3,382,936 was a flexible membrane or bag. When problems develop with this flexible membrane or bag, a solid piston was invented to maintain separation between gas and liquid, as is disclosed in U.S. Pat. No. 3,746,329. Subsequently, there was disclosed another apparatus to accomplish results similar to the above two apparatuses, and in addition a reduction of torsional shock loadinds and vibrations, as may be seen with reference to U.S. Pat. No. 3,998,443.

With respect to the industrial type shock absorber, there is disclosed in U.S. Pat. Nos. 4,055,338 and 4,145,034 a shock absorber particularly adapted for use with a blast hole drill rig. Blast hole drill rigs are utilized to drill shallow holes, approximately fifty feet deep, for lowering and detonating explosives to disintegrate the earth for mining. The shock absorber disclosed in the above two patents is adapted to be placed in the drill string at a location near the surface of the earth. As is the case with shock absorbers used in oil and gas well drilling, gas is utilized for carrying the load imposed upon the drill bit and the shock loading or vibrations transmitted from the drill bit to the surface of the earth and the equipment used to motivate the drill bit. Since air is used as the circulating medium to remove cuttings from the bottom of the bore hole, there is no need for an intermediate or pressure transmitting liquid chamber inside such shock absorbers. Rather, there are seals between the mandrel and tubular body to seal the gas inside the apparatus and prevent lubricant from exiting from the apparatus. The lubricant is necessary in order to provide adequate lubrication to the seals. In the apparatus disclosed in U.S. Pat. Nos. 4,055,338 and 4,145,034 the pressure of the lubricant in the lubricant cavities is maintained intermediate the pressure of the pressurized chamber and ambient. This is beneficial in that none of the seals is exposed to a pressure differential as large as the differential between the pressure inside the pressurized chamber and atmospheric pressure. Hence, the seals are exposed to less stress and deformation and can be expected to have a longer life. In these devices a selected pressure is applied to the lubricant inside the lubricant cavities by injecting lubricant through a grease fitting. The pressure in the lubricant cavities is independent of the pressure in the load transmitting and shock absorbing chamber. In such devices, because of depletion of lubricant, the lubricant pressure will eventually drop. After about eighty to one hundred hours of operation, relubrication is necessary and failure to relubricate can result in substantial damage to the seals and to the shock absorber.

SUMMARY OF THE INVENTION

The invention may be summarized as a shock absorber of the type having a tubular body and a mandrel reciprocally mounted in the body for rotation therewith. This shock absorber has an annular chamber in the body containing fluid under pressure for absorbing load and shock. It also has lubricant cavities between the seals containing lubricant.

A piston is positioned between the mandrel and the tubular body for movement responsive to pressure differential between the load carrying and shock absorbing fluid in the chamber and the lubricant cavities between the seals. The piston is one form of means that may be used to exert a portion of the pressure of the fluid in the load chamber upon the lubricant. The pressure of the lubricant is intermediate the pressure in the load chamber and ambient. As a consequence, the seal between the lubricant cavities and the exterior of the tool is subjected to lower pressure differentials and will have the potential for longer life.

The piston is a differential area piston, having a reduced portion carried within a sleeve that is in contact with the fluid in the chamber. The piston has an enlarged portion carried in the lubricant passage and communicates with the lubricant in the lubricant cavities. The differential areas assure lower pressure in the lubricant cavities than in the pressurized chamber. This reduces the pressure drop across the seal between the pressurized chamber and the lubricant cavities, and also the pressure drop across the seal between the lubricant cavities and ambient. Further, selected pressures are maintained in the lubricant cavities by movement of the piston even after loss of a relatively large quantity of lubricant passed the seals.

DESCRIPTION OF THE PREFERRED EMBODIMENT

Figure 1:
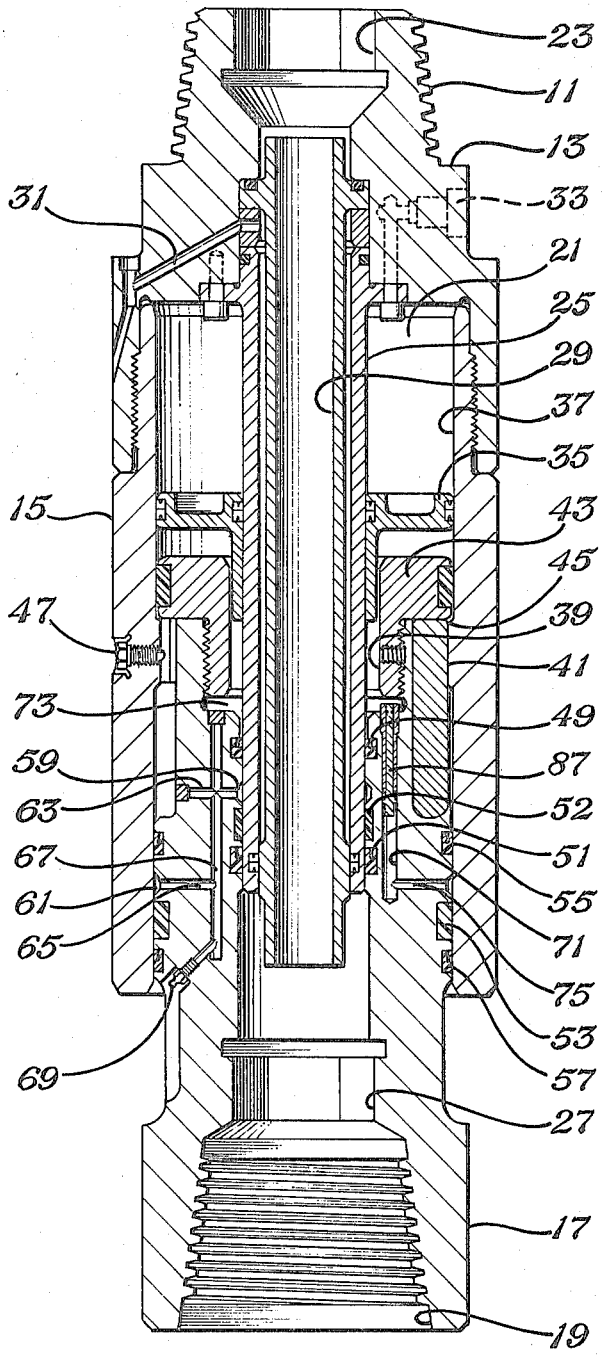
FIG. 1 is a vertical sectional view of a shock absorber constructed in accordance with this invention.

Referring to FIG. 1, a threaded portion 11 protrudes from the top sub 13 for connection to a drill string member (not shown). A cylindrical barrel 15 is screwed to the top sub 13, forming a tubular body in cooperation with top sub 13. A mandrel 17 is reciprocally and telescopingly received in barrel 15. Mandrel 17 has a threaded lower end 19 for connection to another drill string member (not shown). A pressurized fluid chamber 21 between the mandrel 17 and top sub 13 supports the load placed on the drill string and absorbs shock transmitted through the string from the drill bit.

Top sub 13 has an axial passage 23 for transmitting drilling fluid to the drill bit. A tube 25 is secured to the lower end of top sub 13 and extends telescopingly into an axial bore 27 in mandrel 17. A tubular shield 29 is carried concentrically within tube 25. Shield 29 has a smaller outer diameter than the inner diameter of tube 25, providing an insulating clearance as explained in more detail in U.S. Pat. No. 4,145,034, all of which is hereby incorporated by reference. A ventilating passage 31 in top sub 13 communicates the annular space between tube 25 and shield 29 to the exterior. A charging port and valve means 33 is located in the top sub and extends into chamber 21 for introducing gas under pressure. This valve may be similar to that shown in U.S. Pat. No. 3,382,936.

As explained in more detail in U.S. Pat. No. 4,055,338, all of which material is hereby incorporated by reference, a floating piston-type separator 35 is mounted in chamber 21 for dividing the chamber into an upper gas region 37 and a lower liquid region 39. A plurality of drive pins 41 are located in grooves provided in the outer diameter of mandrel 17 and in the inner diameter of barrel 15 for rotating the mandrel with the barrel. A retainer 43 is connected to the top of the mandrel above drive pins 41 for retaining them. Retainer 43 contacts a shoulder 45 when the tool is in the fully extended position, as shown in FIG. 1, preventing mandrel 17 from disengaging itself from the barrel 15. A port 47 in barrel 15 allows liquid to be introduced into the liquid region 39 of chamber 21.

A primary inner load seal 49 is located in an annular groove in bore 27 of mandrel 17 for sealing pressurized fluid in the liquid region 39. A secondary inner seal 51 is located in a groove in the bore 27 below the primary load seal 49. Seal 51 will be adjacent the bottom of tube 25 when the mandrel 17 is at the fully extended position. A Teflon band 52 between inner seals 49 and 51 reduces friction.

The exterior cylindrical surface of mandrel 17 below drive pins 41 is in sliding contact with the inner wall of barrel 15. Friction is reduced by a Teflon band 53. Bands 52 and 53 do not serve to seal pressure. An outer primary load seal 55 is located in a groove on the exterior surface of the mandrel above band 53. A secondary outer load seal 57 is located below band 53. Seal 57 will be adjacent the bottom of barrel 15 when the mandrel 17 is in the fully extended position. Seals 49, 51, 55, and 57 are annular, single resilient seals.

An annular groove or inner lubricant cavity 59 is formed in the bore 27 of mandrel 17 between the inner seals 49 and 51. Similarly, an outer annular groove, or outer lubricant cavity 61 is formed on the exterior cylindrical surface of mandrel 17 between outer seals 55 and 57. The lubricant cavities include the annular clearance space that exists between the primary and secondary seals. A lateral passage 63 is drilled from the exterior of mandrel 17 to inner lubricant cavity 59, then sealed by a steel plug. A lateral passage 65 is drilled inwardly a selected distance from the outer lubricant cavity 61. A longitudinal passage 67 intersects passages 63 and 65. Longitudinal passage 67 extends upwardly from lateral passage 63, and is plugged at the end, creating a standpipe for compressing air located in the passages. A grease fitting 69 is mounted at the bottom of longitudinal passage 67 for the introduction of grease into the passages and cavities.

There are three additional longitudinal passages 71 (only one shown) that extend into a recess 73 formed near the top of mandrel 17. Recess 73 is in communication with the liquid region 39 of the pressurized chamber 21. The longitudinal passages 71 are connected by lateral passages 75 to the outer annular lubricant cavity 61. Since the outer lubricant cavity 61 is in communication with the inner lubricant cavity 59 by way of passage 65, the longitudinal passages 71 will also be in communication with both the inner and outer lubricant cavities. Each lateral passage 75 intersects each longitudinal passage 71 at a selected distance from the bottom of the longitudinal passage.

Figure 2:
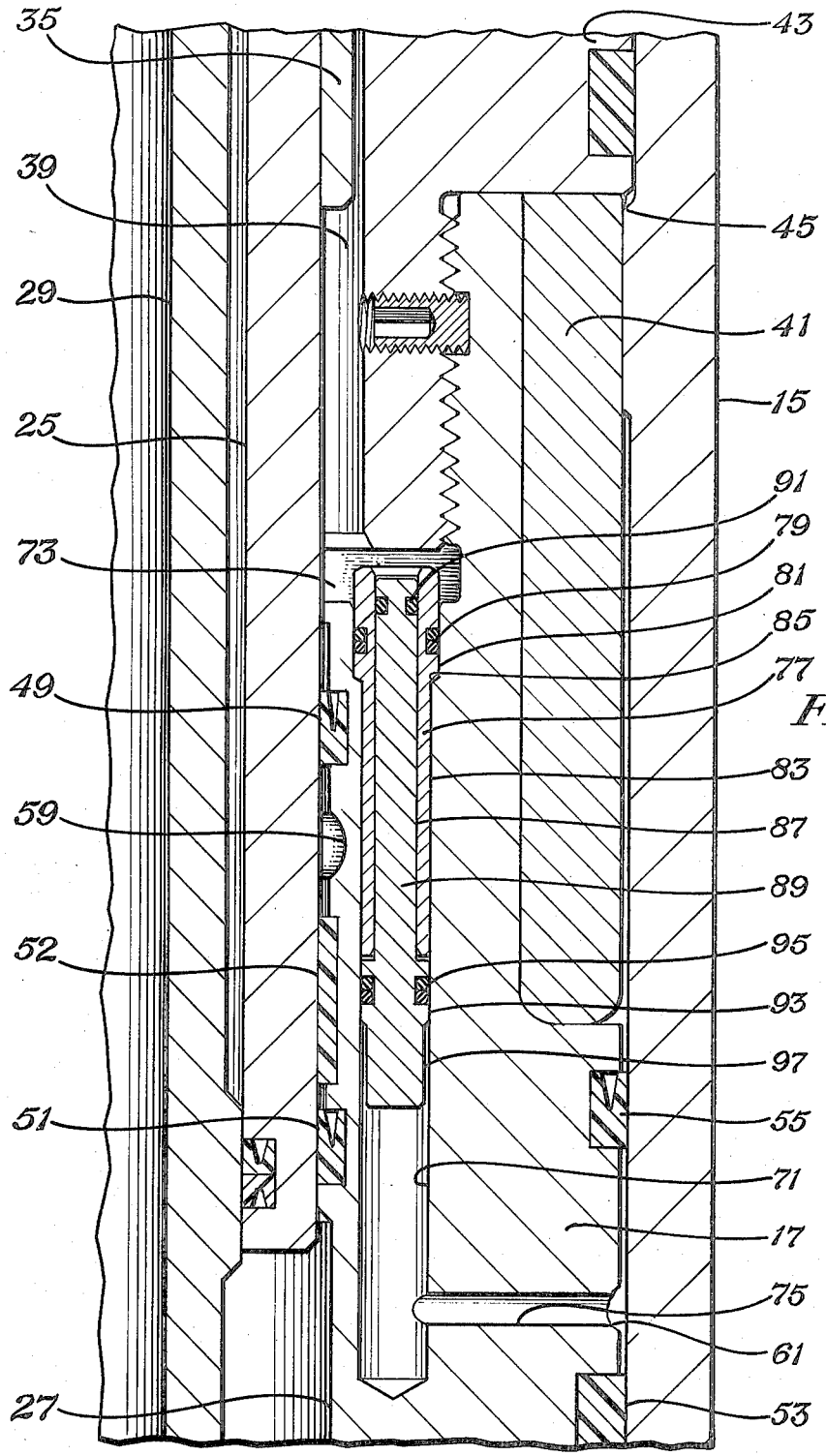
FIG. 2 is a partial, enlarged sectional view of a portion of the shock absorber of FIG. 1.

Referring to FIG. 2, each longitudinal passage 71 contains a sleeve 77. Sleeve 77 is located at the top of the annular passage 71 and sealed in passage 71 by seal 79. Sleeve 77 has an enlarged upper end 81 that fits securely within an enlarged upper portion in the longitudinal passage 71. Sleeve 77 has a reduced diameter lower portion 83 that fits tightly within a reduced diameter portion of passage 71. The enlarged and reduced portions 81 and 83 define a shoulder 85 in passage 71 that faces upwardly and prevents sleeve 77 from moving downward. Retainer 43 limits the upward movement of sleeve 77. When sleeve 77 contacts retainer 43, its seal 79 will still be located within longitudinal passage 71.

A piston 87 is reciprocally and sealingly carried in sleeve 77. Piston 87 has an upper reduced diameter portion 89 that is tightly and slidingly received in the inner bore of sleeve 77. Seal 91 on the reduced portion 89 prevents the leakage of fluid from the liquid region 39 to the longitudinal passage 71. Piston 87 has an enlarged portion 93 intermediate its ends that is tightly received within passage 71. The enlarged portion 93 contains a seal 95 to prevent the leakage of fluid past this portion in passage 71. The diameter and thus the cross sectional area of the enlarged portion 93 is larger than the diameter and cross sectional area of the reduced portion 89. Preferably the cross sectional area of the enlarged portion 93 is two and one-half times the cross sectional area of the reduced portion 89. This differential area will transmit approximately 40% of the pressure in the chamber 21 to the lubricant cavities 59 and 61.

The lower end 97 of piston 87 is of smaller diameter than longitudinal passage 71. The length of the lower end 97, from the bottom to enlarged portion 93, is greater than the distance from the bottom of longitudinal passage 71 to lateral passage 75. This enables lubricant to be pumped through lateral passage 75, and around the clearance between lower end 97 and longitudinal passage 71 to urge the piston 87 upward when lower end 97 is in contact with the bottom of longitudinal passage 71.

To prepare the tool for use, after assembling, a measured amount of liquid, which may be conventional hydraulic oil, is introduced through charge port 47 into the liquid region 39, while trapped air is let out through a bleeder hole (not shown). The liquid fills liquid region 39, including the spaces around the drive pins 41, and the space in the recess 73 of the mandrel 17. Piston separator 35 will move upward to a selected level about one inch above retainer 43. The liquid is substantially incompressible.

Then a gas such as nitrogen is introduced into the gas region 37 through charging port and valve 33. The gas is pressurized to a selected initial charge pressure that is typically between 700 psig (pounds per square inch gage) and 1500 psig, depending upon the loading to be supported by the shock absorber. The piston separator 35 will equalize the pressure in the gas region 37 with the liquid region 39.

If there is no lubricant in longitudinal passage 71, the pressure in chamber 21 will force each piston 87 downward until its lower end 97 is in contact with the bottom of the longitudinal passage 71. The length of sleeve 77 is selected so that seal 91 of the reduced portion 89 will still be located within sleeve 77. The enlarged portion seal 95 will be located slightly above the point where lateral passage 75 intersects the longitudinal passage 71.

A lubricant, such as a molybdenum-based grease is introduced through grease fitting 69. The lubricant fills lateral passages 63, 65 and 75, longitudinal passages 67 and 71 and the cavities 59 and 61. As pressure is applied to the substantailly incompressible lubricant, it compresses air in the upper portion of longitudinal passage 67, above lateral passage 63. It also flows around the end 97 of piston 87 and pushes upwardly on the enlarged portion 93 until the piston 87 and sleeve 77 contact the bottom of retainer 43. The pressure in lubricant cavities 59, 61 will peak once this contact is made. Preferably no more than 700 psig is applied during filling with grease.

Once completely filled, the pressure in the lubricant passages and spaces should be 40% of the charge pressure in the pressurized chamber 21, because of the difference in areas at seals 91 and 95 of piston 87. Primary load seals 49 and 55 prevent the liquid in liquid region 39 from entering the lubricant cavities 59 and 61. The pressure differential across the primary load seals will be the pressure in the pressurized chamber 21 less the pressure in the lubricant cavities 59 and 61, or approximately 60% of the pressure in the pressurized chamber 21. The secondary load seals 51 and 57 prevent leakage of lubricant to the exterior, which is at atmospheric pressure. The pressure drop across these seals will be the pressure in the lubricant cavities 59, 61 less the ambient or atmospheric pressure.

In operation, the threaded portion 11 of top sub 13 is connected with the kelly or an upper drill string member. The threads 19 of mandrel 17 are connected with a depending drill string member that supports the drill bit. Applying weight or force to the bit causes an increased pressure in liquid region 39. The resulting pressure differential across piston separator 35 causes its upward movement, compressing gas in gas region 37 of chamber 21 until the pressures are equalized. Shock loadings are dampened by the compression of the gas in gas region 37. During drilling, the mandrel 17 rotates in unison with the barrel 15, however moves telescopingly in response to the shock and changes in loading.

Piston 87 has its upper face in communication with the liquid in liquid region 39, and its lower face in communication with the lubricant of the lubricant cavities 59 and 61. Piston 87 separates the liquid from the lubricant, and transmits the force exerted by the liquid in the liquid region 39 to the lubricant in the lubricant cavities 59, 61. If the pressure fluctuates in liquid region 39, this fluctuation will also be transmitted to the lubricant cavities 59, 61 by reciprocation of piston 87.

As the lubricant is depleted, the piston 87 moves further downward, still transmitting 40% of the pressure force to the lubricant cavities 59, 61. Once the piston end 97 contacts the bottom of longitudinal passage 71, it is no longer able to transmit force, thus relubrication is necessary. Actual field tests have shown that the shock absorber of this invention is able to operate approximately 10 times as many hours between servicing than the types shown in U.S. Pat. Nos. 4,055,338 and 4,145,034.

It should be apparent from the foregoing that an apparatus having significant advantages has been provided. The piston arrangement provides a positive pressure in the lubricant areas, thus reducing the pressure drop across a single load seal. It maintains the pressure in the lubricant cavities for a longer time period than in the prior art tool. The piston arrangement is simple in construction, and readily adaptable to existing shock absorbers of this nature.

While the invention has been shown in only one of its forms, it should be apparent to those skilled in the art that it is not so limited but is susceptible to various changes and modifications without departing from the spirit thereof.

I claim:

1. In the shock absorbing apparatus for a drill string of the type having a tubular body, a mandrel reciprocally mounted in the body for rotation therewith, an annular chamber in the body containing fluid under pressure for absorbing shock by allowing longitudinal movement of the body and the mandrel with respect to each other, annular and axially spaced seals between the mandrel and an inner wall portion of the body with a sealed lubricant cavity located between the seals containing lubricant, the improvement comprising:

a lubricant passage in the mandrel extending between the chamber and the lubricant cavity; the lubricant passage having a first portion extending into the chamber and a second portion extending into the lubricant cavity that is larger in cross-sectional dimension than the first portion; and a differential area piston reciprocally and sealingly carried in the lubricant passage first and second portions to provide a lesser pressure in the lubricant cavity than in the chamber and a higher pressure than ambient.

2. In a shock absorbing apparatus for a drill string of the type having a tubular body, a mandrel reciprocally mounted in the body for rotation therewith, an annular chamber in the body containing fluid under pressure for absorbing shock by allowing longitudinal movement of the body and the mandrel with respect to each other, annular and axially spaced seals between the mandrel and an inner wall portion of the body with a sealed lubricant cavity located between the seals containing lubricant, the improvement comprising:

a longitudinal passage in the mandrel extending between the chamber and the lubricant cavity;

a sleeve inside the longitudinal passage; and a differential area piston reciprocally and sealingly carried in the sleeve, with a smaller area carried in the sleeve in communication with the fluid in the chamber and a larger area carried in the longitudinal passage in communication with the lubricant in the lubricant cavity.

3. In a shock absorbing apparatus for a drill string of the type having a tubular body, a mandrel reciprocally mounted in the body for rotation therewith and having an axial passage for the transmission of drilling fluid, an annular chamber in the body containing fluid under pressure for absorbing shock by allowing longitudinal movement of the body and the mandrel with respect to each other, annular and axially spaced seals between the mandrel and an inner wall portion of the body with a sealed lubricant cavity located between the seals containing lubricant, the improvement comprising:

a longitudinal passage in the mandrel extending between the chamber and the lubricant cavity and having an axis offset laterally from the axis of the axial passage;

a sleeve inside the longitudinal passage; and a differential area piston having a smaller area reciprocally and sealingly carried in the sleeve and a larger area reciprocally and sealingly carried in the longitudinal passage.

* * * * *